United States Patent [19]

Gonzalez

[11] 3,988,946

[45] Nov. 2, 1976

[54] MANIPULATING MEMBER FOR A ROTATING SHAFT

[75] Inventor: Boris Gonzalez, Issy-les-Moulineaux, France

[73] Assignee: Societe Anonyme Automobiles Citroen, Paris, France

[22] Filed: June 6, 1975

[21] Appl. No.: 584,418

[30] Foreign Application Priority Data

June 20, 1974 France ..... 74.21476

[52] U.S. Cl. ..... 74/545; 74/548; 403/359; 403/365; D8/152

[51] Int. Cl.[2] ..... G05G 1/10; G05G 1/12

[58] Field of Search ..... 74/548, 545, 543; 403/359, 365; D8/152; 16/110 R

[56] References Cited

UNITED STATES PATENTS

| | | | |
|---|---|---|---|
| 1,207,329 | 5/1916 | Roush | 74/548 |
| 1,257,799 | 2/1918 | Brown | 74/548 |
| 1,555,352 | 9/1925 | Brown | 74/548 |

FOREIGN PATENTS OR APPLICATIONS

| | | | |
|---|---|---|---|
| 1,181,840 | 6/1959 | France | 74/545 |
| 1,227,458 | 8/1960 | France | 74/545 |

*Primary Examiner*—Samuel Scott
*Assistant Examiner*—F. D. Shoemaker
*Attorney, Agent, or Firm*—Lewis H. Eslinger; Alvin Sinderbrand

[57] ABSTRACT

The rotating shaft manipulating member comprises at least one body having a boss provided with elements for driving the shaft, for fixing the body onto the shaft, and a turning knob. The boss comprises a bush slotted parallel to its axis and the above-mentioned body has two spaced parts joined at one of their ends to the bush on either side of the slot and carrying at their other end a half-journal whose axis is parallel to that of the bush, while the turning knob comprises a ring which grips the two half-journals and maintains them in a close together position.

10 Claims, 8 Drawing Figures

MANIPULATING MEMBER FOR A ROTATING SHAFT

The present invention relates to a member for manipulating a rotating shaft.

Generally shaft manipulating members or cranks comprise a body including a boss for engaging the shaft to be turned, a gripping knob and means securing the knob to a pivot pin, secured on the body of the manipulating member. This type of construction has disadvantages in that it involves the use of a large number of components, with the consequent expensive assembly operations. Moreover the locking device for the body of the member on the shaft to be controlled involves the use of clips, nuts and keys which are difficult to reach and manipulate.

An object of the present invention is to obviate these disadvantages by use of a device which performs the same functions as previously proposed cranks but which uses a smaller number of component parts. Moreover the invention also advantageously permits the realisation of numerous esthetic variants of the crank. The installation and dismantling of the crank of the present invention can also be performed in simple manner without it being necessary to use ancillary devices or tools.

In accordance with an aspect of the present invention a member for manipulating a rotating shaft, i.e. a crank, is provided which comprises at least one body having a turning knob and a boss provided with elements for driving or turning a shaft and securing the body on the shaft. The boss comprises a bush slotted parallel to its axis, and the body has two spaced parts joined at one of their ends to the bush on either side of the slot and carrying at their other end a half-journal, or semi-cylindrical projection, whose axis is parallel to that of the bush. A turning button or knob is provided which comprises a ring that grips the two half-journals and maintains them in close proximity to each other.

The said slotted bush includes means for driving the shaft to be controlled and means for axially locking the manipulating member on the said shaft which are actuated by the fitting of the ring on the half journals, as described hereinafter.

Advantageously the half-journals have an upper shoulder for maintaining in position the ring which grips them.

According to a preferred embodiment of the manipulating member of the invention, the bush, the component parts of the body and the journals carried by the same all formed as a rigid frame covered with a deformable foamed plastic material provided with a decorative skin.

The covering of the component parts of the body can either be discontinuous, thus leaving a central space in the body, or continuous and total, so that a solid body is obtained.

Thus, in the space existing between the two half-journals after fitting the ring thereon it is possible to join a decorative element such as a key or cap to the member according to the invention, the said element being force-fitted into the said space.

The invention will be better understood from reading the following description relative to an indicative and non-limitative embodiment, whereby the secondary advantages and characteristics will become more clearly apparent. Reference will be made to the following drawings wherein.

Figure 4:
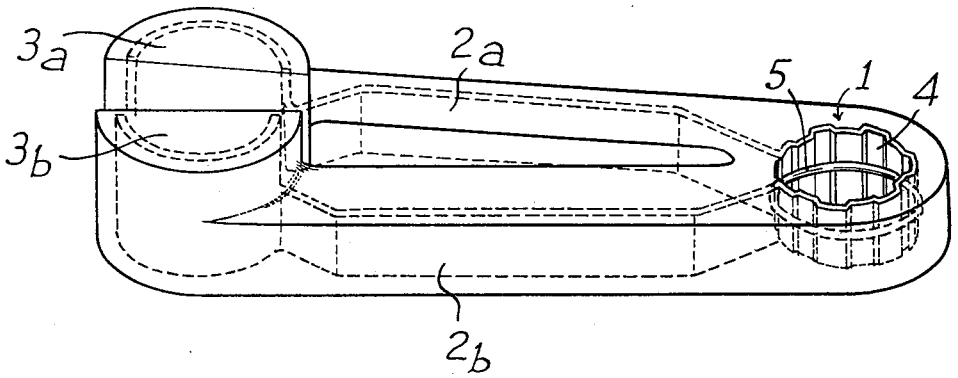
FIG. 4 is a perspective view of an embodiment of the frame of a member according to the invention for coating with a foamed plastic material.

FIGS. 5, 6, 7 and 8 views of various possible coverings for the frame of FIG. 4 with a ring and decorative elements.

Figure 1:
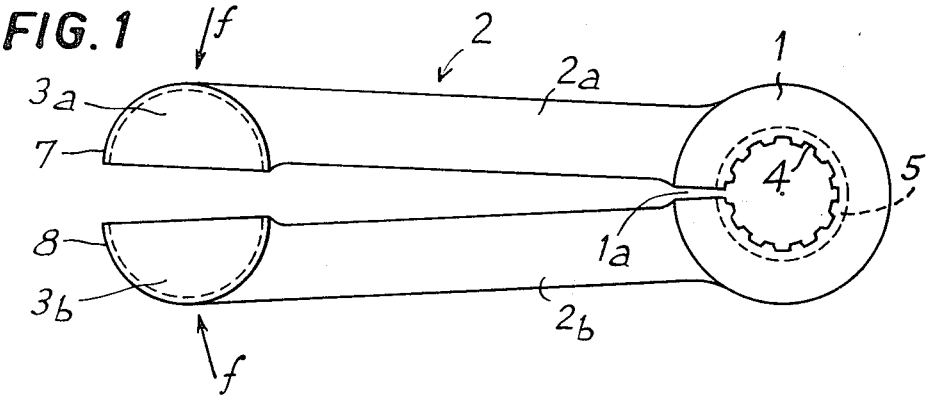
FIGS. 1 and 2 are plan views of the crank member according to the invention.
Figure 2:
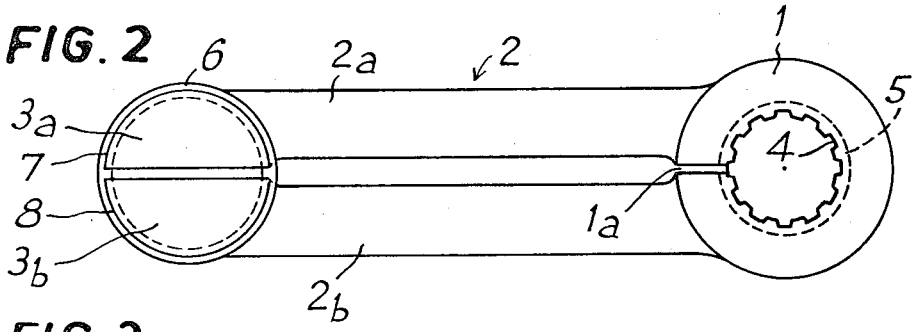
Figure 3:
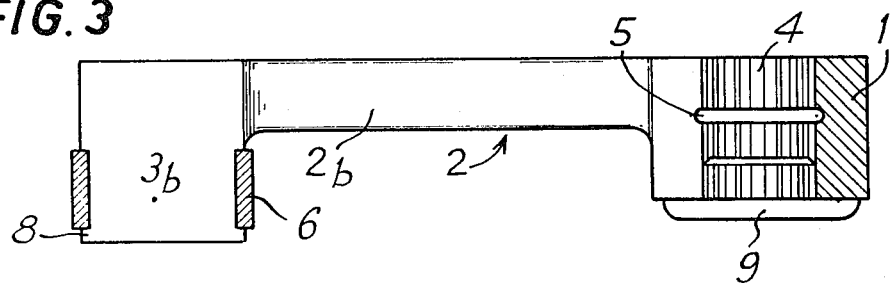
FIG. 3 is a longitudinal sectional view of the crank of FIGS. 1 and 2.

Referring now to FIGS. 1–3, a manipulating member or crank is illustrated which consists of a boss 1 and a crank body 2. The boss or bush (these words are used interchangeably herein) is slotted at 1*a* and body 2 comprises two arms 2*a* and 2*b* fixed at one of their ends to bush 1 at either side of the slot 1*a*. At their other ends these arms carry half-journals (i.e. generally semi-cylindrical projections) 3*a* and 3*b*, whose axis is parallel to that of boss 1. The member or crank shown in FIG. 1 is in the general form of a clamp and when a pressure is applied to the half-journals 3*a* and 3*b*, in the direction of arrows *f* in FIG. 1 the two arms 2*a* and 2*b* are moved together and the width of gap 1*a* is reduced. Boss 1 is provided internally with means for driving a shaft (not shown). That means comprises a plurality of slots or channels 4 formed in the internal bore of the bush which can cooperate with corresponding channels on the shaft to be controlled. The bore of bush 1 also includes means for axially locking the manipulating member or crank onto the shaft to hold the crank against axial movement. This means comprises a groove 5 formed therein which is adapted to cooperate with a corresponding bead carried by the shaft.

FIGS. 2 and 3 show a ring 6 gripping half-journals 3*a* and 3*b* and maintaining them close together. Ring 6 is maintained on the half-journals by flanges 7 and 8 provided on their upper end opposite to the fitting point on arms 2*a* and 2*b*. Finally FIG. 3 shows a plug 9 sealing the grooved bore of boss 1.

The manipulating member according to the invention as shown in FIGS. 1 – 3 is made from a rigid material (i.e. a metal or plastic material).

To mount the manipulating member according to the invention in the configuration of FIG. 1 it is positioned to face the shaft to be controlled. When slid along the shaft, accompanied by the application of a slight pressure the bead on the shaft enters groove 5.

In this connection it should be noted that the groove 5 can be carried by the shaft and the bead by the boss of the manipulating member. This mounting of boss 1 on the shaft is facilitated by the elasticity given to the boss by slot 1*a*. This fitting is then locked by moving the half-journals 3*a* and 3*b* together and placing the gripping ring 6 on the half journals between shoulders 7 and 8. The diameter of shoulders 7 and 8 should be less than the diameter of the ring when the half-journals 3*a* and 3*b* are in contact with one another to permit the said introduction.

The clamp constituting boss 1 and arms 2*a* and 2*b* is kept closed by ring 6. This reduces the size of slot 1*a* and boss 1 thus is tightly gripped around the shaft to be controlled. This gripping produces a deeper penetration of the shaft bead into groove 5 and guarantees the locking of the manipulating member onto the shaft to be controlled. It also ensures a closer connection with plug 9, which, being fitted before ring 6, is shrunk into the boss.

It is obvious that the very design of the manipulating member according to the invention permits a very easy and almost instantaneous assembly and disassembly, without difficult operations or the use of ancillary tools and components with reference to the boss. It involves the use of a reduced number of parts while retaining the advantages of a handle or gripping knob of the member which does not turn in the hand of the user. Ring 6 can in fact slide around half-journals 3*a* and 3*b* on manipulating the member according to the invention and remains fixed in the hand of the operator. The friction of this ring on the half-journals depends on the elastic constraint which it imposes on the member whilst maintaining the two arms 2*a* and 2*b* together.

FIG. 4 shows a simplified form of the body of the member according to the invention, wherein the reference numerals uses are the same as in FIG. 1.

This simplified form is for covering with a foamed plastic material which can be deformed to a considerable extent and which is provided with a decorative skin for esthetic reasons. The simplified body shown in FIG. 4 therefore constitutes the frame of the manipulating member according to the invention, permitting it to retain all the functions indicated hereinbefore, as well as all its advantages. This frame can be constructed either from separate components (bushes, metal strips, half-tubes, etc) assembled by welding or from a cut, shaped metal strip as shown in FIG. 4.

FIGS. 5 to 8 show different embodiments of the invention made from foamed plastic material covering a frame.

Figure 5:
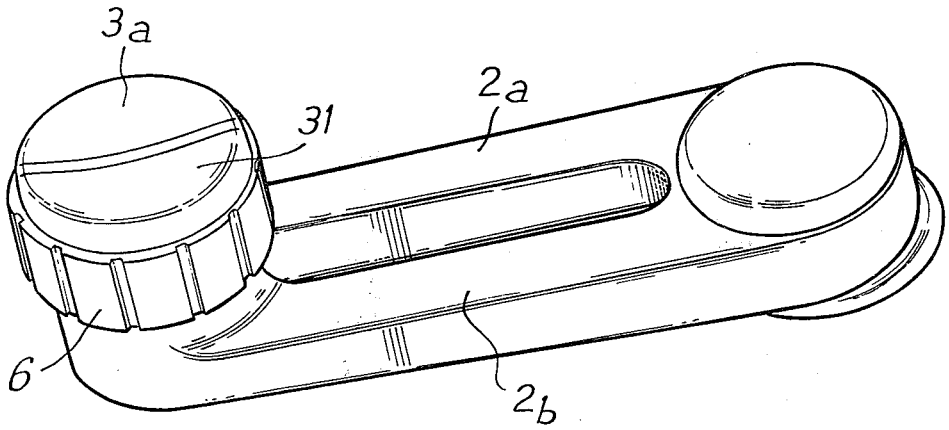

The embodiment of FIG. 5 is similar to that of FIGS. 1 to 3 but the slot 1*a* in FIGS. 1 to 3 is here filled with the plastic material. This does not prevent the elastic deformation of the boss due to the great deformation capacity of the plastic.

Figure 6:
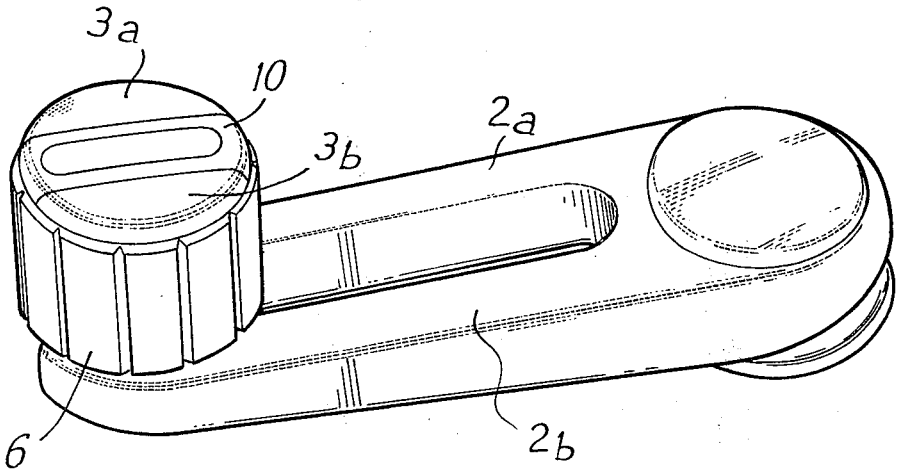

FIG. 6 shows a decorative element 10, force-fitted into the slot separating the two half-journals 3*a* and 3*b* gripped by ring 6. Decorative element 10 is a type of key.

Figure 7:
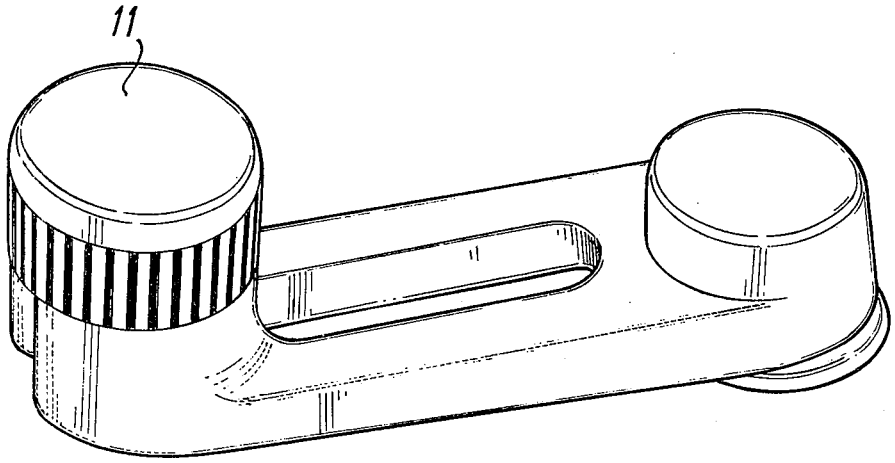

In FIG. 7 the decorative element is a cap 11 with a stud which is also force-fitted into the slot separating the said half-journals. It should be noted that the stud of cap 11 or the sidewalls of key 10 can be provided with grooves or lugs able to cooperate with corresponding members provided in the sides of the half-journals adjacent to the slot separating the same.

Figure 8:
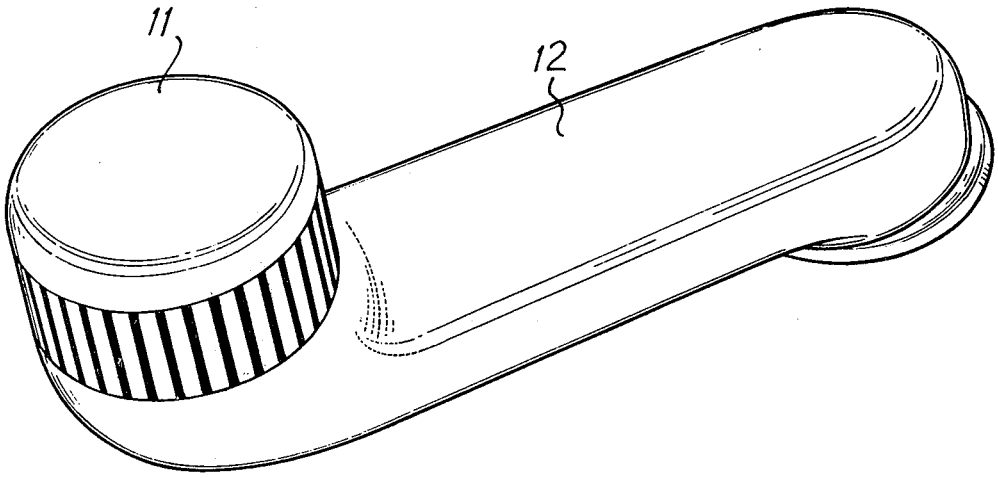

Finally in the embodiment of FIG. 8 a solid member 12 is provided in addition to cap 11. The two arms of the frame in FIG. 4 are then embedded in one and the same plastic material without compromising the operation of these arms defined hereinbefore due to the flexibility of the material. It should be noted that during the fitting of the ring the elements of the frame can only be displaced to a limited extent.

These drawings show that the invention makes it possible to obviate traditional operational restraints while simultaneously greater esthetic freedom is possible.

An interesting application of the object of the present application is encountered in the automobile industry where it can be used to operate automobile windows.

The invention is not limited to the embodiments described hereinbefore and in fact covers all possible variants thereof which do not pass beyond the scope of the invention, particularly that not shown comprising a steering wheel whose boss and one of its arms are slotted and can be brought together by means of a ring gripping two half-journals carried by the said steering wheel on either side of the slot.

What is claimed is:

1. A manipulating member for rotating a shaft comprising at least one body element for driving the shaft including a boss having a bore formed therein for receiving the shaft and having a slot formed therein parallel to the axis of said bore and two spaced parts respectively joined at one of their ends to said boss on either side of the slot and including at their other end a generally semicylindrical projection whose axis is parallel to that of the boss; and an annular ring surrounding the two semi-cylindrical projections and maintaining them in close proximity to each other.

2. A manipulating member according to claim 1, wherein the slotted boss includes means in said bore for keying the boss to the shaft and means for axially locking the manipulating member onto the shaft actuated by placement of the ring on said projections.

3. A manipulating member according to claim 1, wherein the projections each have a shoulder formed therein for maintaining the ring thereon.

4. A manipulating member according to claim 1, wherein said member, including said boss, said two spaced parts and the projections form a relatively rigid frame; and a deformable foamed plastic material provided with a decorative skin covering said frame.

5. A manipulating member according to claim 4, wherein said frame is formed of a metal strip.

6. A manipulating member according to claim 4, wherein the two spaced parts of the body are individually covered with said foamed plastic material.

7. A manipulating member according to claim 4, wherein the two spaced parts of the body are embedded in said foamed plastic material, which material fills the space separating them.

8. A manipulating member according to claim 1, including a decorative element force fitted in the space between said projections and held there by the ring.

9. A manipulating member according to claim 8, wherein said decorative element is solid key.

10. A manipulating member according to claim 8, wherein the said decorative element is a cap.

* * * * *